United States Patent [19]

Kane et al.

[11] 4,355,216

[45] Oct. 19, 1982

[54] ELECTRIC SWITCH

[75] Inventors: Hugh Kane, Chagrin Falls; Bradford J. Williams, Willowick, both of Ohio

[73] Assignee: GTE Products Corporation, Stamford, Conn.

[21] Appl. No.: 221,962

[22] Filed: Jan. 2, 1981

[51] Int. Cl.[3] ..... H01H 15/00; H01H 1/20

[52] U.S. Cl. ..... 200/16 A; 200/243; 200/303

[58] Field of Search ..... 200/16 A, 76, 163, 243, 200/245-247, 280, 281, 284, 303, 307

[56] References Cited

U.S. PATENT DOCUMENTS

| | | | |
|---|---|---|---|
| 2,930,859 | 3/1960 | Nolden et al. | 200/16 A |
| 3,045,092 | 7/1962 | Bundy | 200/243 |
| 3,253,092 | 5/1966 | Landow | 200/16 A |
| 3,437,773 | 4/1969 | Koertge | 200/243 |
| 3,586,795 | 6/1971 | Mentel et al. | 200/16 A |
| 4,064,381 | 12/1977 | Mullen et al. | 200/16 A |
| 4,121,076 | 10/1978 | Taylor et al. | 200/280 |

FOREIGN PATENT DOCUMENTS

| | | | |
|---|---|---|---|
| 2743156 | 4/1979 | Fed. Rep. of Germany | 200/16 A |

*Primary Examiner*—J. R. Scott

*Attorney, Agent, or Firm*—David M. Keay

[57] ABSTRACT

Pushbutton switch module having a molded unitary case and a movable contact carrier carrying a conductive contact bridge mounted therein. Two stationary contact members each have a contact arm and a stabilizing arm which extend from a field termination exterior of the case into slots in the side walls of the case. The contact arms extend through the respective slots into the interior of the case where they are contacted by the conductive contact bridge. A cover which closes off the interior of the case has pins projecting therefrom. The pins extend through passageways at the end surfaces of the side walls and into openings in one of the arms of each stationary contact member thus securing the stationary contact members in fixed position in the case.

19 Claims, 9 Drawing Figures

ELECTRIC SWITCH

BACKGROUND OF THE INVENTION

This invention relates to electric switches. More particularly, it is concerned with pushbutton electric switch modules having a pair of terminals which are switched between a normally-open and a closed condition or between a normally-closed and an open condition.

Pushbutton electric switches are widely used in circuits controlling electrical apparatus. One type of switch employs switch modules arranged togwther and mounted on a single actuator. Each module contains a pair of stationary contacts with field terminations for external wiring, and may operate in a normally-open or a normally-closed mode. The modules have similar physical configurations so as to permit mounting on an actuator in tandem and also in side-by-side relationship.

It is desirable for switch modules of the type described to be simple with a minimum number of parts, and with parts which are easy to fabricate and which permit rapid assembly. It is also desirable that many of the parts be common to both normally-open and normally-closed switched modules. In addition, the switch modules should be easy to mount on an actuator, and the field terminations should be readily accessible for connecting and disconnecting electrical circuitry thereto.

SUMMARY OF THE INVENTION

An improved switch module of the pushbutton type in accordance with the present invention includes in combination a case of insulating material having walls defining a central compartment. A contact carrier is mounted in the compartment so as to permit guided reciprocal movement between first and second positions. The contact carrier is urged toward the first position by a biasing means. The switch module includes first and second stationary contact members which have contact surfaces adjacent to one end and field terminations adjacent to the opposite end. The walls of the case have apertures therethrough for receiving the two stationary contact members with the contact surfaces within the compartment and with the field terminations exterior of the compartment. A conductive contact bridge is mounted on the contact carrier. The conductive contact bridge makes contact with the contact surfaces of the stationary contact members to provide a closed circuit therebetween when the contact carrier is in one of the two positions. The conductive contact bridge is spaced from the contact surfaces of the stationary contact members to provide an open circuit therebetween when the contact carrier is in the other of the two positions. A cover of insulating material is attached to the case and forms a closure of the central compartment. The cover has means which engage the first and second stationary contact members and secures them is fixed position with respect to the case.

For a better understanding of the present invention, together with other and further objects, advantages, and capabilities thereof, reference is made to the following disclosure and appended claims in connection with the above-described drawings.

DETAILED DESCRIPTION OF THE INVENTION

Figure 1:
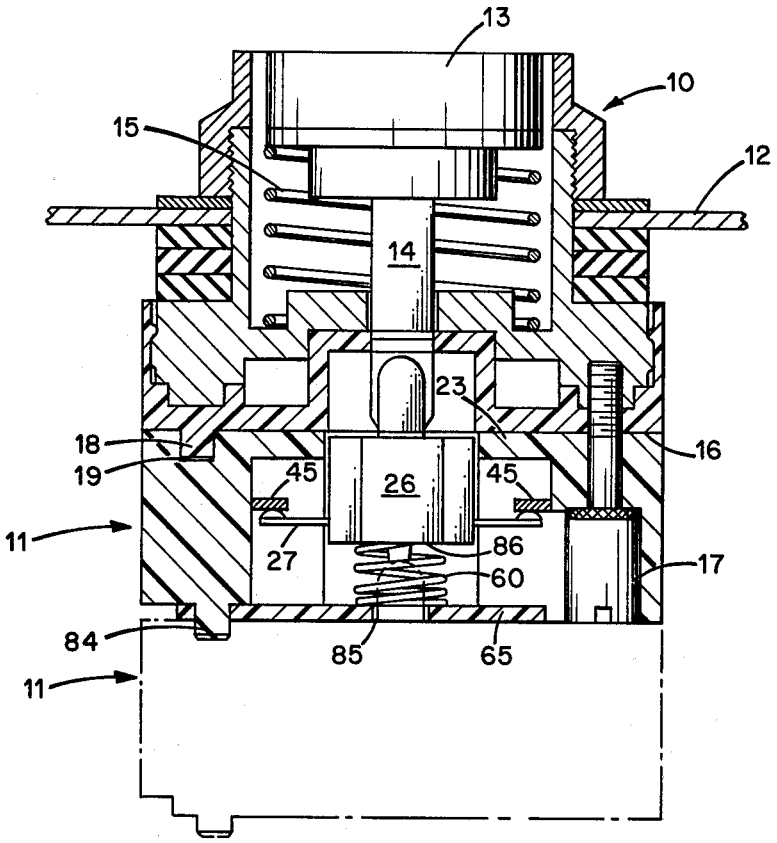
FIG. 1 is an elevational view of a normally-closed switch module in accordance with the invention, mounted on a pushbutton actuator, shown partially in cross-section taken along the line 1—1 of FIG. 2.
Figure 2:
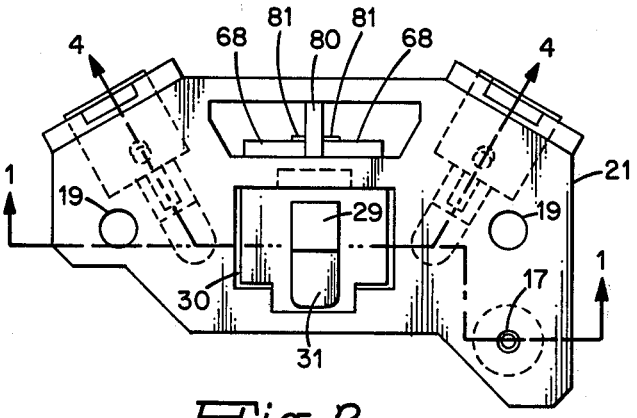
FIG. 2 is a top view of the switch module of FIG. 1 as oriented in the drawings.
Figure 3:
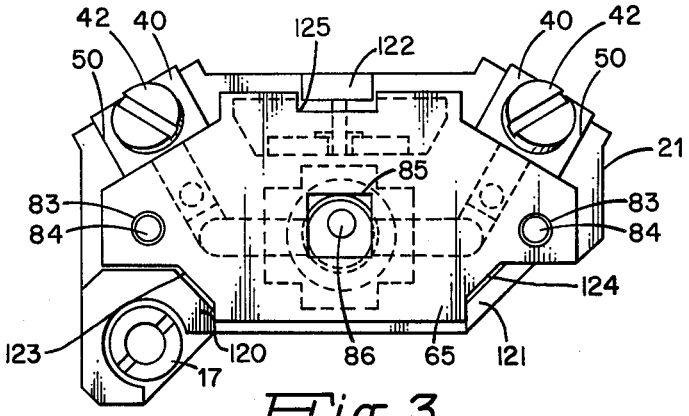
FIG. 3 is a bottom view of the switch module of FIG. 1 as oriented in the drawings.

FIG. 1 illustrates a pushbutton actuator 10 of known type having a switch module 11 in accordance with the present invention mounted thereon. A second switch module 11 is illustrated in phantom mounted in tandem on the first switch module. The actuator includes an arrangement for mounting the actuator at an opening in a panel 12. The actuator includes a button 13 which is attached to an actuator rod 14. The actuator rod 14 and button 13 are biased upwardly as shown in FIG. 1 by a return compression spring 15. The actuator has a mounting platform 16 on which the switch module 11 is mounted in position to be operated by movement of the actuator rod 14. The switch module is held in place by a single captive screw 17 and locating pins 18 on the actuator which fit in recesses 19 in the upper surface of the switch module. The configuration of the switch module 11 permits side-by-side mounting of switch modules on the actuator and stacking of the modules in tandem so that movement of the actuator rod 14 operates several switch modules.

The switch module of the present invention may be of either the normally-closed or normally-open type. FIGS. 1 through 8 illustrate a switch module 11 of the normally-closed type. The housing of the switch module includes a molded unitary case 21 of a suitable insulating material which can best be seen in the exploded view of FIG. 8. The molded case includes side walls 22 and an end wall 23 normal to the side walls defining a central compartment within the case. The end wall 23 is not visible in FIG. 8, but is shown in the elevational views of FIGS. 1 and 4 and the top views of FIGS. 2 and 5. The interior configuration of the side walls 22 provides sets of guideways 24 and 25 for a contact carrier 26. The guideways 24 and 25 provide lateral stability preventing rotation of the contact carrier 26 while permitting reciprocating movement of the contact carrier in the direction toward and away from the end wall 23.

Figure 4:
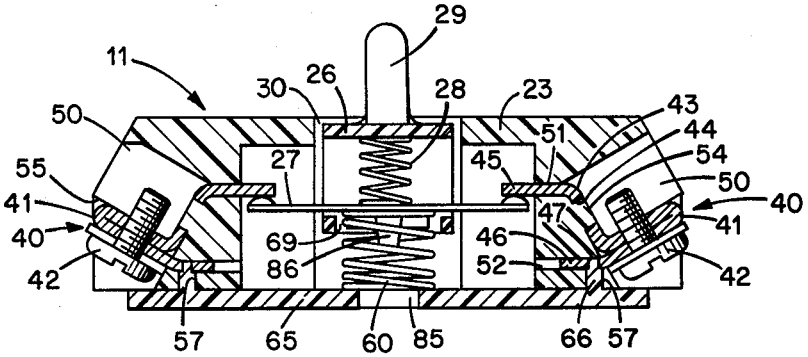
FIG. 4 is an elevational view of the switch module taken generally along the line 4—4 of FIG. 2.
Figure 5:
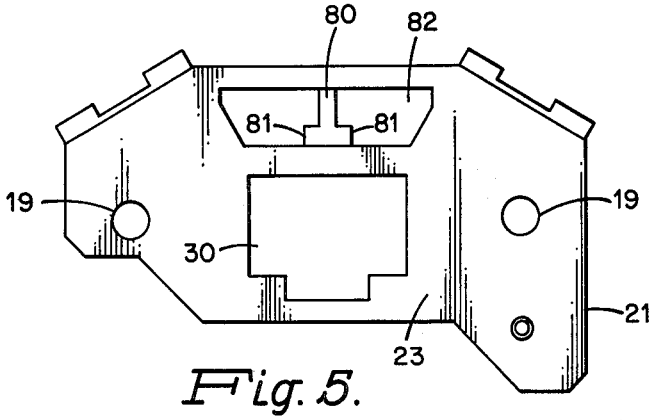
FIG. 5 is a top view of the case of the housing of the switch module.
Figure 6:
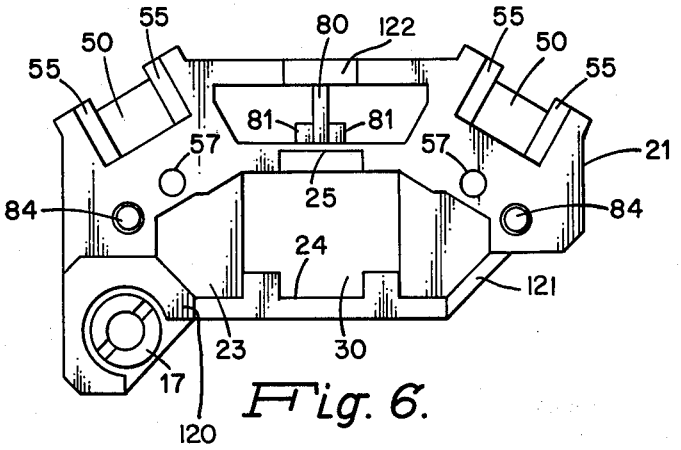
FIG. 6 is a bottom view of the case of the housing of the switch module.
Figure 7:
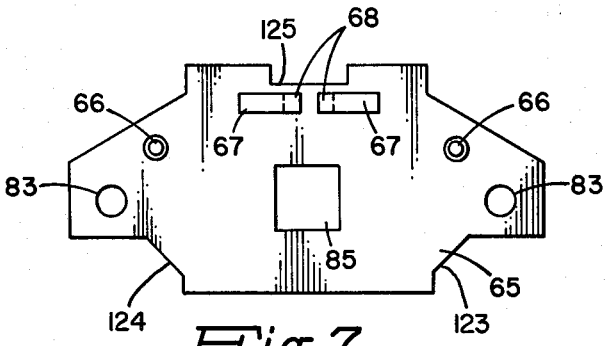
FIG. 7 is a top view of the cover of the housing of the switch module.

A contact carrier 26 has a mating configuration for fitting within the guideways 24 and 25. The contact carrier 26 carries a conductive contact bridge 27 which has contact surfaces on appropriate surfaces. For normally-closed switch modules the contact surfaces are on the upper surfaces as shown in the figures. A compression spring 28, as shown in FIG. 4, provides a biasing force urging the conductive bridge 27 downward in the contact carrier 26. The contact carrier 26 has a protruding end portion 29 which extends through an opening 30 in the end wall 23, and also has a bearing surface 31 adjacent to the projection 29 which is exposed through the opening 30 in the end wall 23. A portion of the contact carrier 26 abuts the end wall 23 adjacent to the opening 30 thus limiting movement of the contact carrier in the direction toward the end wall.

The switch module includes two similar stationary contact members 40 each of which includes a field termination 41 having a threaded hole for receiving a connecting screw 42. Each stationary contact member has a contact arm 43 extending from the field termination 41. The contact arm 43 includes a section generally normal to the field termination with a slot 44 therein. A contact section 45 of the contact arm with a contact surface at the end thereof extends from the slotted section. A short stabilizing arm 46 also extends from the field termination 41 generally parallel to the contact section 45 and at an angle to the field termination 41. The stabilizing arm 46 has an opening 47 therethrough.

The stationary contact members 40 are positioned in recesses 50 in the side walls of the case 21. The case 21 has two sets of two slots 51 and 52 each in the side walls 22. The slots extend from the recesses 50 at the exterior of the case through the side walls to the central compartment. The slots of each pair are parallel to the end walls 23. Each pair of slots receives a stationary contact member 40 with the contact section 45 of the contact arm in the slot 51 which is nearer the end wall. The contact surface at the end of the contact arm is positioned within the central compartment of the case. The other slot 52 of the pair receives the stabilizing arm 46. A boss 54 on the case projects into the slot 44 in the contact arm 43. The field terminations 41 are supported by sloping shoulders 55 at the sides of the recesses 50 which lie parallel to the respective field terminations. The openings 47 through the stabilizing arms 46 of the contact members are aligned with passageways 57 which extend from the lower edge surface of the side walls to the slots 52. The passageways 57 are normal to the slots 51 and 52.

The cover 65 which completes the housing is a molded unitary structure of insulating material providing a generally flat, planar member disposed parallel to the end wall 23 for closing the open end of the case 21. The cover 65 has two projections 66 extending normal to the closure member. The projections or pins 66 are located within the passageways 57 in the case 21 when the cover is in position on the case. Pins 66 pass through the passageways 57 into the openings 47 in the stabilizing arms 46 of the stationary contact members 40 holding the contact members fixed in position in the case. The portions of the side walls 22 encircling the passageways 57 prevent lateral movement of the pins 66 thus providing support therefor.

Also extending from the flat closure portion of the cover 65 are bifurcated arms 67 having hooks 68 at the ends thereof. The bifurcated arms 67 pass on opposite sides of a septum 80 in a cavity 82 in the side walls when the cover is inserted in place. The arms 67 are deflected outward by ramps 81 which contact the hooks 68. When the cover is in its proper position in contact with the edge surfaces of the side walls 22, the hooks 68 clear the ends of the ramps 81 and the arms 67 move inward. The hooks 68 abut the shoulders at the ends of the ramps locking the cover in place. Openings 83 in the cover 65 are engaged by bosses 84 at the edge surfaces of the side walls 22 of the case 21. Projections 120, 121 and 122 from the side walls 22 of the case 21 fit into notches 123, 124 and 125, respectively, in the cover 65. The cover 65 also has an opening 85 which provides access to the under surface 86 of the contact carrier 26. The opening 85 is aligned with the projection 29 of the contact carrier 26 so as to accommodate the projection of an adjacent switch module when the modules are mounted on the actuator 10 in tandem.

A compression spring 60 is positioned between the contact carrier 26 and the cover 65. The spring 60 fits within a recess 69 in the under surface of the contact carrier and is in contact with the contact bridge 27 thereby urging the contact bridge into contact with the stationary contact members 40. The compression spring 60 biases the contact carrier and contact bridge upward into the normally-closed contact condition. When the contact carrier is forced downward by the actuator rod 14 of the actuator 10, or by the contact carrier of an adjacent switch module, the contact bridge is moved away from the stationary contacts thus providing an open circuit between the stationary contact members 40. When the actuator rod, or contact carrier of the adjacent module, moves upward, the force of the compressed spring 60 returns the contact carrier and contact bridge to the original position providing a closed circuit between the stationary contact members.

As indicated hereinabove, the switch module is mounted in proper position on the platform 16 of the actuator 10 by a single captive screw 17 together with mating bosses 18 on the actuator platform and recesses 19 in the upper surface of the switch module. The screw 17 is threaded internally at the lower end so as to permit threaded engagement with the externally threaded stud portion of the screw of another switch module. The bosses 84 at the lower edge surface of the side walls which fit in the openings 83 in the cover 65 extend beyond the cover and are aligned with the recesses 19 in the upper surface of the switch module. Thus, a second or subsequent switch module can be mounted in tandem beneath a switch module as illustrated in phantom in FIG. 1. The screw engages the screw 17 in the upper module and the recesses 19 in the upper surface receives the bosses 84 of the upper module. As explained previously, the projection 29 of the contact carrier 26 of the lower module extends through the opening 85 in the cover of the upper module abutting the under surface of the contact carrier 26 of the upper module. The stationary contact members 40 are recessed into the wall structure of the module with the field terminations 41 disposed at an angle with respect to the end wall of the module. Their location and the angle at which they lie permit ready access to all the field terminations when several modules are stacked in tandem.

The switch module in accordance with the present invention as described permits of rapid, simple assembly. With the case 21 inverted from the position as shown in the drawings, the stationary contact members 40 are places in position in the recesses 50 in the side walls 22 with the arms in the slots 51 and 52. The subassembly of the contact carrier 26 with the contact bridge 27 and compression spring 28 is placed in the central compartment and is properly located by the guideways 24 and 25. The return spring 60 is placed in the recess 69 in the contact carrier 26. Then the cover 65 is inserted in place in snap-engagement over the open end of the case closing the central compartment. At the same time the pins 66 on the cover become inserted through the passageways 57 in the side walls of the case and into the openings 47 in the stabilizing arms 46 of the stationary contact members 40, thus securing the stationary contact members in fixed position.

Figure 9:
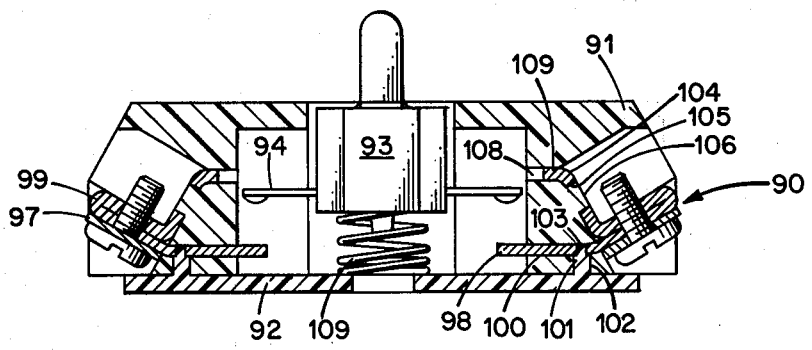
FIG. 9 is an elevational view in cross-section similar to the view of FIG. 4 of a normally-open switch module in accordance with the present invention.
Figure 8:
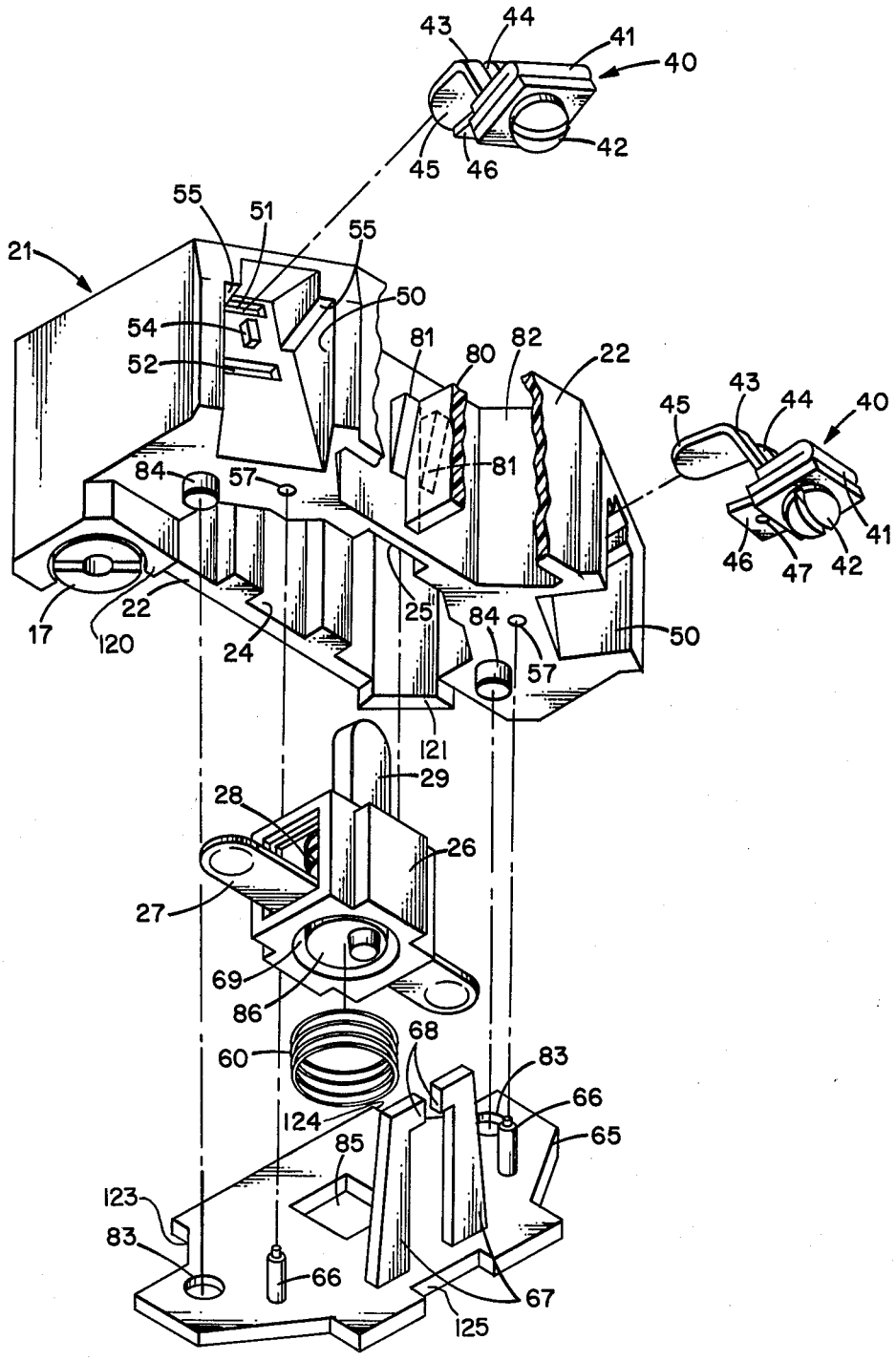
FIG. 8 is an exploded view in perspective illustrating the elements of the switch module with portions broken away.

FIG. 9 is a cross-sectional view similar to that of FIG.4 of a normally-open type switch module 90 in accordance with the present invention. In switch modules for operation in this mode the case 91, the cover 92, and the contact carrier 93 are physically the same as those of the module 11 previously described in detail. The conductive contact bridge 94 is also identical except that its position in the contact carrier is inverted so that the contact surfaces are on the underside rather than the upper side.

As can be seen in FIG. 9 the stationary contact members 97, however, are different from those in the embodiment previously described. A contact arm 98 extends directly from the field termination 99 through the slot 100 adjacent to the cover 92 and into the central compartment. The pins 101 on the cover 92 extend through passageways 102 in the side walls of the case and into openings 103 in the contact arms 98, thus holding the stationary contact members 97 in position in the case 90. A stabilizing arm 104 includes a section normal to the field termination 99 having a slot 105 which accommodates a boss 106 in the case. Another section 107 of the stabilizing arm 104 extends parallel to the contact arm 98 and into a slot 108 in the case.

In the normally-open switch module 90 as shown in FIG. 9 the contact carrier 93 and conductive contact bridge 94 are normally biased by a compression spring 109 away from the contact surfaces of the stationary contact members 97 thus providing an open circuit between the stationary contact members. When the contact carrier 93 is moved downward, the conductive contact bridge 94 makes contact with the contact surfaces producing a closed circuit between the stationary contact members 97.

While there has been shown and described what are considered preferred embodiments of the present invention, it will be obvious to those skilled in the art that various changes and modifications may be made therein without departing from the invention as defined by the appended claims.

What is claimed is:

1. A switch module including in combination a case of insulating material having walls defining a central compartment;

a contact carrier mounted in the compartment for guided reciprocal movement between a first and a second position;

biasing means for urging the contact carrier toward said first position;

first and second stationary contact members each having a contact surface adjacent to one end thereof and a field termination adjacent to the opposite end thereof;

the walls of the case having apertures therethrough for receiving the first and second stationary contact members with the contact surfaces within the compartment and with the field terminations exterior of the compartment;

a conductive contact bridge mounted on said contact carrier; said conductive contact bridge making contact with the contact surfaces of the first and second stationary contact members to provide a closed circuit therebetween when the contact carrier is in one of said positions, and being spaced from the contact surfaces of the first and second stationary contact members to provide an open circuit therebetween when the contact carrier is in the other of said positions; and a cover of insulating material attached to the case and forming a closure of the central compartment;

said cover having means engaging said first and second stationary contact members and securing them in fixed position with respect to the case.

2. A switch module in accordance with claim 1 wherein said cover has first and second projections extending into engagement with the first and second stationary contact members, respectively; and said first and second stationary contact members each have means engaging said first and second projections, respectively, to secure the stationary contact members in fixed position in said apertures in the walls of the case.

3. A switch module in accordance with claim 2 wherein the walls of the case have first and second passageways therein extending from adjacent to said cover to adjacent to said first and second stationary contact members, respectively; said passageways receiving said projections of the cover with the portions of the walls encircling the passageways providing support for the projections.

4. A switch module in accordance with claim 3 wherein the walls of the case have first and second pairs of parallel slots therethrough;

each of said stationary contact members includes first and second arms extending from adjacent to the field termination, one of said arms of each of the stationary contact members extends through one of said slots of a pair into the compartment and has a contact surface adjacent to the end thereof within the compartment;

the other of said arms of each of the stationary contact members extends into the other of said slots of the pair; and the first arm of each of said stationary contact members has an opening therein for receiving one of said projections of the cover.

5. A switch module in accordance with claim 4 wherein the first arm of each of said stationary contact members extends through one of said slots into the compartment and has a contact surface adjacent to the end thereof within the compartment; and said conductive contact bridge is in contact with the contact surfaces of the first and second stationary contact members when the contact carrier is in the second position and is spaced from the contact surfaces when the contact carrier is in the first position whereby said switch module operates in a normally-open mode.

6. A switch module in accordance with claim 4 wherein the second arm of each of said stationary contact members extends through one of said slots into the compartment and has a contact surface adjacent to the end thereof within the compartment; and said conductive contact bridge is in contact with the contact surfaces of the first and second stationary contact members when the contact carrier is in the first position and is spaced from the contact surfaces when the contact carrier is in the second position whereby said switch module operates in a normally-closed mode.

7. A switch module in accordance with claim 4 wherein the field termination of each stationary contact member lies at an angle with respect to said one arm of the stationary contact member;

the walls of the case have first and second recesses therein for receiving the field terminations of the first and second stationary contact members, respectively; and the portions of the walls defining each of said recesses have shoulders lying parallel to the respective field termination for providing support for the field termination.

8. A switch module in accordance with claim 4 wherein said case and said cover include mating snap-engagable means for attaching the cover to the case.

9. A switch module including in combination a unitary case of insulating material having side walls and an end wall defining a central compartment open at one end;

a contact carrier mounted in the compartment for guided reciprocal movement between a first and a second position along a line toward and away from said end wall;

biasing means for urging the contact carrier toward said first position;

first and second stationary contact members each having a contact surface adjacent to one end thereof and a field termination adjacent to the opposite end thereof;

the side walls of the case having apertures therethrough for receiving the first and second stationary contact members with the contact surfaces within the compartment and with the field terminations exterior of the compartment;

a conductive contact bridge mounted on said contact carrier; said conductive contact bridge making contact with the contact surfaces of the first and second stationary contact members to provide a closed circuit therebetween when the contact carrier is in one of said positions, and being spaced from the contact surfaces of the first and second stationary contact members to provide an open circuit therebetween when the contact carrier is in the other of said positions; and a cover of insulating material attached to the case and forming a closure of the open end of the central compartment;

said cover having means engaging said first and second stationary contact members and securing them in fixed position with respect to the case.

10. A switch module in accordance with claim 9 wherein said cover has first and second projections extending into engagement with the first and second stationary contact members, respectively; and said first and second stationary contact members each have means engaging said first and second projections, respectively, to secure the stationary contact members in fixed position in said apertures in the side walls of the case.

11. A switch module in accordance with claim 10 wherein the side walls of the case have first and second passageways therein extending from the edge surfaces thereof adjacent to said cover to adjacent to said first and second stationary contact members, respectively; said passageways receiving said projections of the cover with the portions of the side walls encircling the passageways providing support for the projections.

12. A switch module in accordance with claim 11 wherein the side walls of the case have first and second pairs of parallel slots therethrough;

each of said stationary contact members includes first and second arms extending from adjacent to the field termination;

one of said arms of each of the stationary contact members extends through one of said slots of a pair into the compartment and has a contact surface adjacent to the end thereof within the compartment;

the other of said arms of each of the stationary contact members extends into the other of said slots of the pair; and the first arm of each of said stationary contact members has an opening therein for receiving one of said projections of the cover.

13. A switch module in accordance with claim 12 wherein the first arm of each of said stationary contact members extends through one of said slots into the compartment and has a contact surface adjacent to the end thereof within the compartment; and said conductive contact bridge is in contact with the contact surfaces of the first and second stationary contact members when the contact carrier is in the second position and is spaced from the contact surfaces when the contact carrier is in the first position whereby said switch module operates in a normally-open mode.

14. A switch module in accordance with claim 12 wherein the second arm of each of said stationary contact members extends through one of said slots into the compartment and has a contact surface adjacent to the end thereof within the compartment; and said conductive contact bridge is in contact with the contact surfaces of the first and second stationary contact members when the contact carrier is in the first position and is spaced from the contact surfaces when the contact carrier is in the second position whereby said switch module operates in a normally-closed mode.

15. A switch module in accordance with claim 12 wherein the field termination of each stationary contact member lies at an angle with respect to said one arm of the stationary contact member;

the side walls of the case have first and second recesses therein at the exterior thereof for receiving the field terminations of the first and second stationary contact members, respectively; and the portions of the side walls defining each of said recesses have shoulders lying parallel to the respective field termination for providing support for the field termination.

16. A switch module in accordance with claim 11 wherein said end wall has an aperture therethrough;

said contact carrier has a portion at one end thereof projecting through said aperture in the end wall when the contact carrier is in said first position; and said cover has an aperture therein for receiving said portion of the contact carrier of a switch module when two switch modules are arranged in tandem.

17. A switch module in accordance with claim 16 wherein the edge surfaces of said side walls of the case adjacent to said cover lie generally in a plane normal to the line of movement of the contact carrier;

said cover includes a flat, planar closure portion in contact with said edge surfaces of the side walls; and said biasing means for urging the contact carrier toward said first position comprises a compression spring positioned between said cover and said contact carrier.

18. A switch module in accordance with claim 17 wherein the side walls of the case have a cavity therein extending from the edge surfaces adjacent to said cover in the direction of the line of movement of the contact carrier;

a ramp located within said cavity has a shoulder at the end thereof spaced from the cover;

said cover has an arm extending from the closure portion and having engagement surfaces adjacent to the end thereof spaced from said closure portion; and said engagement surfaces of said arm engage said shoulder of the ramp providing snap-in engagement of said cover and said case.

19. A switch module in accordance with claim 11 wherein the side walls of the case have first and second pairs of parallel slots therethrough, each slot lying generally parallel to said end wall and to said cover;

the first slot of each pair being more closely adjacent to the end wall and the second slot of each pair being more closely adajcent to the cover;

each of said stationary contact members includes first and second arms extending from adjacent to the field termination;

one of said arms of each of the stationary contact members extends through one of said slots of a pair into the compartment and has a contact surface adjacent to the end thereof within the compartment;

the other of said arms of each of the stationary contact members extends into the other of said slots of the pair; and the first arm of each of said stationary contact members has an opening therein for receiving one of said projections of the cover;

whereby when stationary contact members having said contact surfaces on said first arms are positioned in said case with the first arms in the second slots and with the second arms in the first slots, said contact surfaces of said first arms are in contact with the conductive bridge when the contact carrier is in the second position and are spaced from the conductive contact bridge when the contact carrier is in the first position providing operation of the switch module in a normally-open mode; and when stationary contact members hving said contact surfaces on said second arms are positioned in said case with the first arms in the second slots and with the second arms in the first slots, said contact surfaces of said second arms are in contact with the conductive contact bridge when the contact carrier is in the first position and are spaced from the conductive contact bridge when the contact carrier is in the second position providing operation of the switch module in a normally-closed mode.

* * * * *